US009623273B1

(12) United States Patent
Chen

(10) Patent No.: US 9,623,273 B1
(45) Date of Patent: Apr. 18, 2017

(54) HAND HELD SLIDING EXERCISING DEVICE

(71) Applicant: Paul Chen, Taichung (TW)

(72) Inventor: Paul Chen, Taichung (TW)

( * ) Notice: Subject to any disclaimer, the term of this patent is extended or adjusted under 35 U.S.C. 154(b) by 0 days.

(21) Appl. No.: 14/946,829

(22) Filed: Nov. 20, 2015

(51) Int. Cl.
*A63B 71/00* (2006.01)
*A63B 21/00* (2006.01)
*A63B 21/068* (2006.01)

(52) U.S. Cl.
CPC .... *A63B 21/0004* (2013.01); *A63B 21/00181* (2013.01); *A63B 21/068* (2013.01); *A63B 21/4035* (2015.10)

(58) Field of Classification Search
USPC ..... 482/1–148
See application file for complete search history.

(56) References Cited

U.S. PATENT DOCUMENTS 4,136,867 A 1/1979 Wilkin
4,339,127 A 7/1982 Mitchell
5,707,325 A 1/1998 Chiou
6,129,651 A * 10/2000 Denaro ..... A63B 21/00047 482/141
6,146,318 A 11/2000 Kuo
6,196,955 B1 3/2001 Chuang
7,468,025 B2 * 12/2008 Hauser ..... A63B 21/00047 482/141
7,553,267 B1 * 6/2009 Hauser ..... A63B 21/00047 482/141
7,981,016 B1 * 7/2011 Howard ..... A63B 21/0004 482/141
8,702,575 B2 * 4/2014 McVay ..... A63B 21/068 482/121
9,028,382 B2 * 5/2015 Chang ..... A63B 22/20 482/132
9,132,316 B2 * 9/2015 Lima ..... A63B 23/1236
9,199,117 B1 * 12/2015 Nicholas ..... A63B 21/0004
9,539,465 B2 * 1/2017 Agostini ..... A63B 22/18
2012/0083396 A1 * 4/2012 Aquino ..... A63B 21/0004 482/131

* cited by examiner

*Primary Examiner* — Stephen Crow
(74) *Attorney, Agent, or Firm* — Charles E. Baxley

(57) ABSTRACT

An exercising device includes a housing member having one or more rollers, and having a handle device, the handle device is pivotally attached to the housing member with a pivot spindle for allowing the handle device to be rotated relative to the housing member between an upwardly extended working position and a folding position. The handle device includes two end portions pivotally attached to the housing member with the pivot spindle. The housing member includes two seats for engaging with the end portions of the handle device and for supporting the handle device at the upwardly extended working position.

3 Claims, 10 Drawing Sheets

HAND HELD SLIDING EXERCISING DEVICE

BACKGROUND OF THE INVENTION

1. Field of the Invention

The present invention relates to a wheeled hand-held sliding or gliding exercising device, and more particularly to a hand held sliding or gliding exercising device including a handle detachably or changeably or removably attached or mounted or secured to a wheeled housing member for allowing the handle to be selectively attached to the wheeled housing member at a working position or at a compact folding or receiving position.

2. Description of the Prior Art

Various kinds of typical wheeled and torsional hand-held exercising devices have been developed and provided for conducting or operating various push and pull exercises and for exercising or training the upper muscle groups and the abdominal portion of the user, and normally comprise a handle attached or mounted or secured to a wheeled housing member for allowing the wheeled housing member to be moved forwardly and rearwardly on a supporting surface or ground with the handle.

For example, U.S. Pat. No. 4,136,867 to Wilkin, U.S. Pat. No. 4,339,127 to Mitchell, U.S. Pat. No. 5,707,325 to Chiou, U.S. Pat. No. 6,146,318 to Kuo, and U.S. Pat. No. 6,196,955 to Chuang disclose several of the typical wheeled and torsional hand-held sliding exercising devices each also comprising a handle solidly and stably attached or mounted or secured to a wheel or a wheeled housing member for allowing the wheeled housing member to be moved forwardly and rearwardly on a supporting surface or ground with the handle.

However, the handle is normally solidly and stably attached or mounted or secured to the wheel or the wheeled housing member and may not be detached or disengaged or separated from the wheel or the wheeled housing member such that the typical wheeled and torsional hand-held sliding exercising devices may include a large volume that is adverse for storing and transportation purposes and that may not be easily carried with the user.

The present invention has arisen to mitigate and/or obviate the afore-described disadvantages of the conventional exercising devices.

SUMMARY OF THE INVENTION

The primary objective of the present invention is to provide a hand held sliding or gliding exercising device including a handle detachably or changeably or removably attached or mounted or secured to a wheeled housing member for allowing the handle to be selectively attached to the wheeled housing member at a working position or at a compact folding or receiving position.

In accordance with one aspect of the invention, there is provided an exercising device comprising a housing member including at least one roller attached to the housing member for allowing the housing member to be moved forwardly and rearwardly or sidewise on the supporting surface or ground, and a handle device pivotally attached to the housing member with a pivot spindle for allowing the handle device to be rotated relative to the housing member between an upwardly extended working position where the handle device may be grasped and held by the user, and a folding position where the handle device may be folded to the housing member at a compact folding and storing position and which is excellent for storing and transportation purposes.

The handle device includes two end portions pivotally attached to the housing member with the pivot spindle for allowing the handle device to be rotated relative to the housing member. The housing member includes two seats for engaging with the end portions of the handle device and for supporting the handle device at the upwardly extended working position.

The housing member includes a bulge extended therefrom for forming or defining the seats and for engaging with the end portions of the handle device. The seats are formed or defined at the end portions of the bulge. The housing member includes a recess formed in an upper portion of the housing member for engaging with a soft pad.

One of the housing members may include a male engaging member provided thereon, and an auxiliary housing member may include a female engaging member provided thereon for engaging with the male engaging member and for allowing the two housing members to be selectively coupled together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
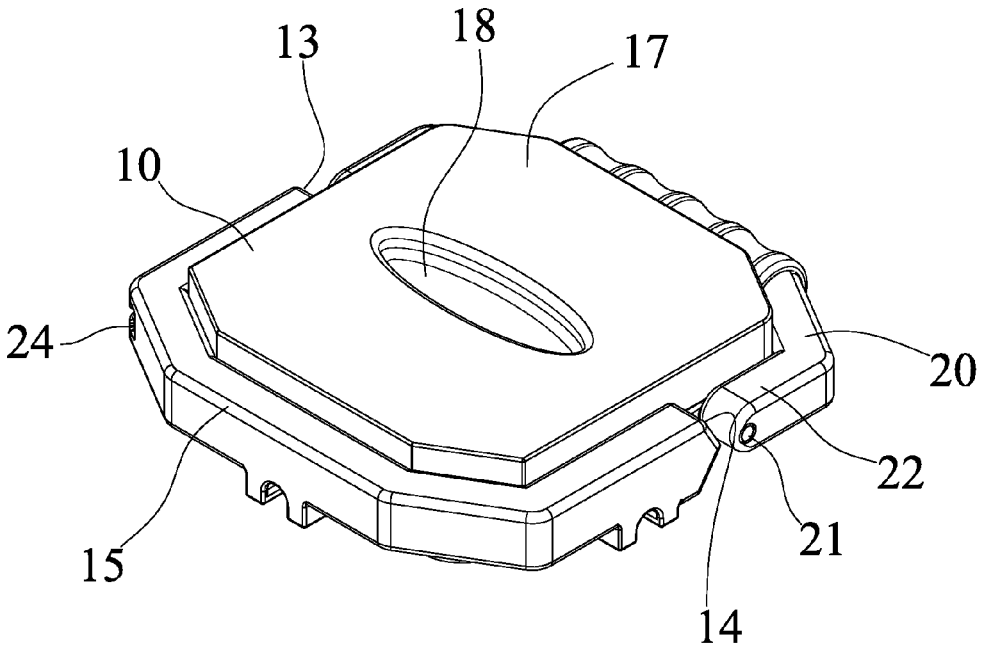
FIG. 1 is an upper perspective view of a wheeled and hand-held sliding or gliding exercising device in accordance with the present invention.
Figure 2:
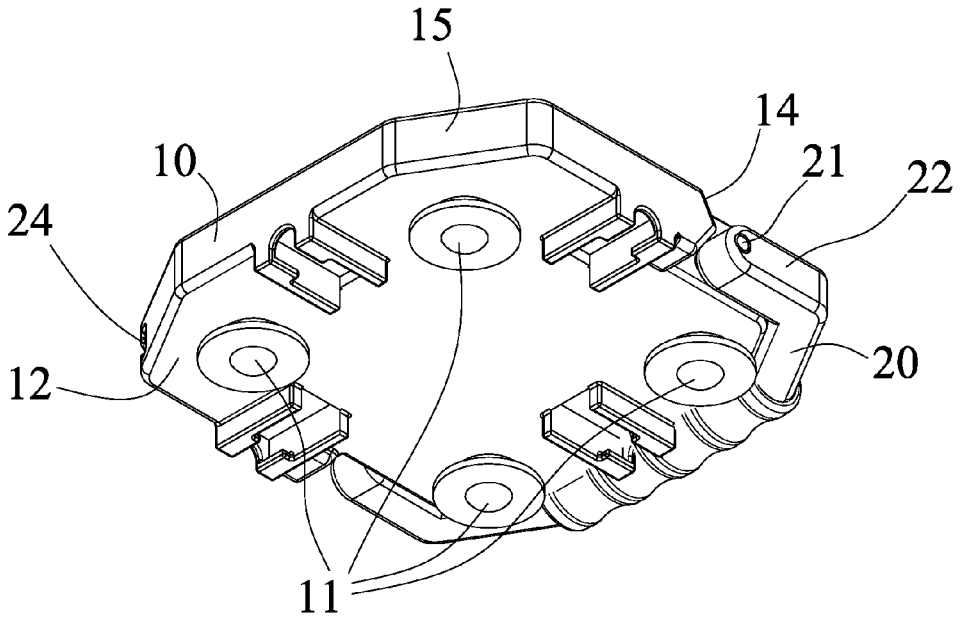
FIG. 2 is a bottom perspective view of the exercising device.
Figure 3:
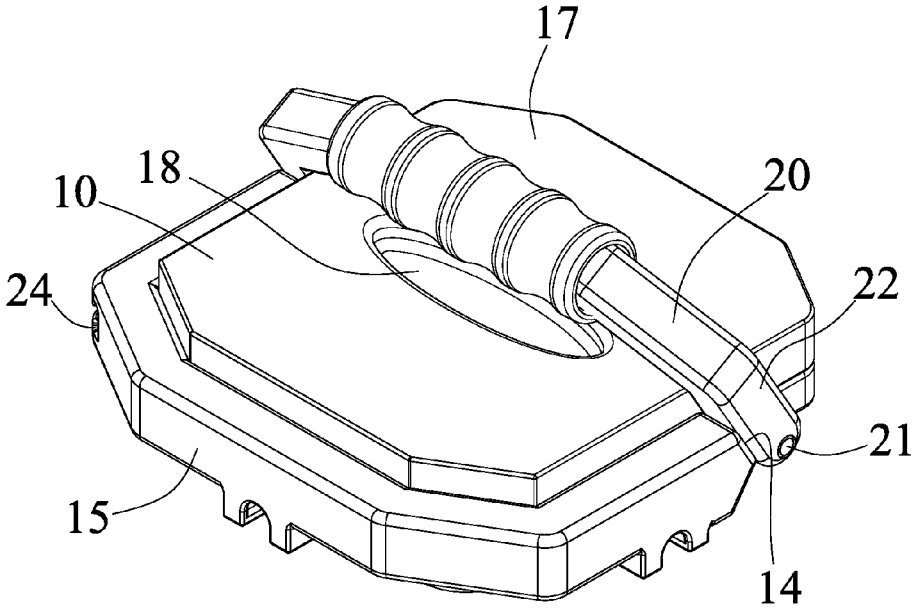
FIG. 3 is another upper perspective view similar to FIG. 1, illustrating the operation of the exercising device.
Figure 4:
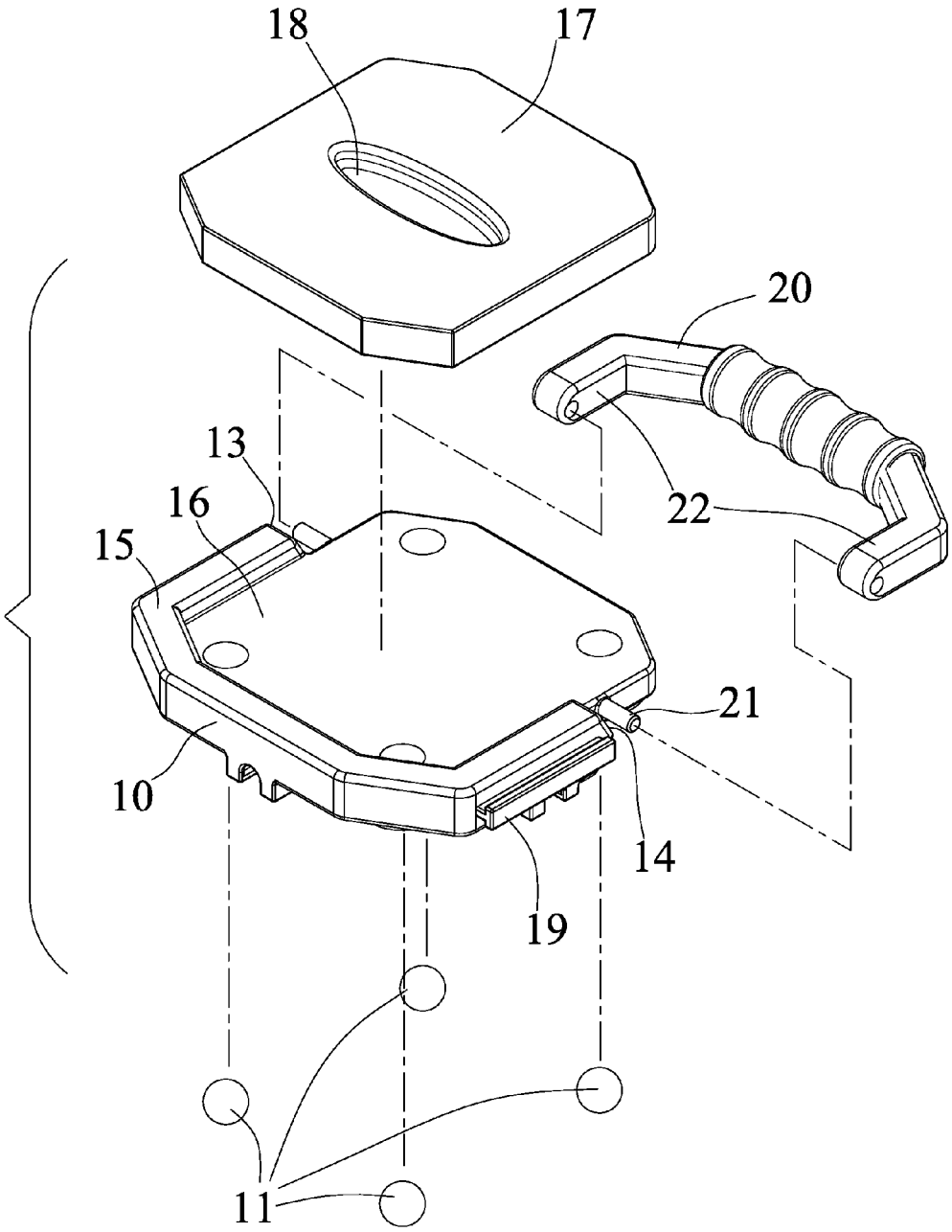
FIG. 4 is a partial exploded view as seen from the upper portion of the exercising device.

Referring to the drawings, and initially to FIGS. 1-5, a wheeled and hand-held sliding or gliding exercising device in accordance with the present invention comprises one or more (such as two) sliding or housing members 10 (FIGS. 6-15) each including one or more (such as four) wheels or rollers 11 attached to the lower or bottom portion 12 of the housing member 10 for engaging with the supporting surface or ground and for allowing the housing members 10 to be moved forwardly and rearwardly or sidewise on the supporting surface or ground (FIGS. 6-15). The housing members 10 each include one or more (such as two) stops or seats 13, 14 formed or provided therein.

For example, the housing members 10 each include a peripheral swelling or bulge 15 extended upwardly from the outer peripheral portion thereof for forming or defining the seats 13, 14 at the end portions of the bulge 15, and for forming or defining a recess 16 in the upper portion of the housing member 10 (FIG. 4), and for selectively receiving or engaging with a cover or plate or pad 17 therein. It is preferable that the pad 17 includes one or more holes or cavities 18 or a rough surface formed or provided therein for softly or frictionally engaging with the hands (FIG. 7), the elbows (FIG. 8), the knees (FIG. 9), the buttocks (FIG. 10), and/or the feet (FIG. 11) of the user 8.

The housing members 10 each further includes a handle device 20 pivotally or rotatably attached or mounted or secured to the respective housing member 10 with a pivot spindle 21 for allowing the handle device 20 to be pivoted or rotated relative to the housing member 10 and for allowing the handle device 20 to be selectively attached to the wheeled housing member 10 at an upwardly extended working position (FIGS. 3 and 12-15) or at a compact folding or receiving position (FIGS. 1-2 and 7-11). The handle device 20 each include two end portions 22 pivotally attached to the housing member 10 with the pivot spindle 21 and engageable with and/or seated on the seats 13, 14 of the housing member 10 for allowing the handle device 20 to be anchored or retained on the upwardly extended working position and for being gripped or grasped or held by the user 8.

As best shown in FIGS. 1-2 and 7-11, when the end portions 22 of the handle device 20 are disengaged or separated from the seats 13, 14 of the housing member 10, the handle device 20 may be pivoted or rotated or folded relative to the housing member 10 to a horizontal position substantially parallel to the housing member 10 and the bulge 15 and the pad 17 at the compact folding or receiving position. The soft or cushion pad 17 may thus be received or engaged in the bulge 15 and the handle device 20, or the bulge 15 and the handle device 20 are arranged or disposed or located around the pad 17 when the handle device 20 is pivoted or rotated or folded relative to the housing member 10 to the compact folding or receiving position.

In operation, as shown in FIGS. 12-15, the handle device 20 may be pivoted or rotated relative to the housing member 10 to the upwardly extended working positions, and the handle device 20 may be gripped or grasped or held by the user 8 for conducting or operating the push and pull exercises, for example. As shown in FIGS. 6-11, the handle device 20 may also be selectively pivoted or rotated or folded relative to the housing member 10 to the compact folding or receiving position for allowing the exercising device to be selectively contacted or engaged with the various portions of the user 8, such as the hands (FIG. 7), the elbows (FIG. 8), the knees (FIG. 9), the buttocks (FIG. 10), and/or the feet (FIG. 11) of the user 8 and thus for allowing the user 8 to conduct or operate the push and pull exercises, for example.

When the handle device 20 is pivoted or rotated or folded relative to the housing member 10 to the compact folding or receiving position, the compact folding or receiving position of the hand-held sliding or gliding exercising device in accordance with the present invention is excellent for storing and transportation purposes and that may be easily carried with the user 8. As shown in FIG. 6, one of the housing members 10 may include a male engaging member 19 formed or provided thereon (FIGS. 4-6), and the other or auxiliary housing member 10 may include a female engaging member 24 formed or provided thereon (FIGS. 1-3, 6) for engaging with the male engaging member 19 and for allowing two of the housing members 10 to be selectively connected or coupled together as a one-piece housing member.

Figure 5:
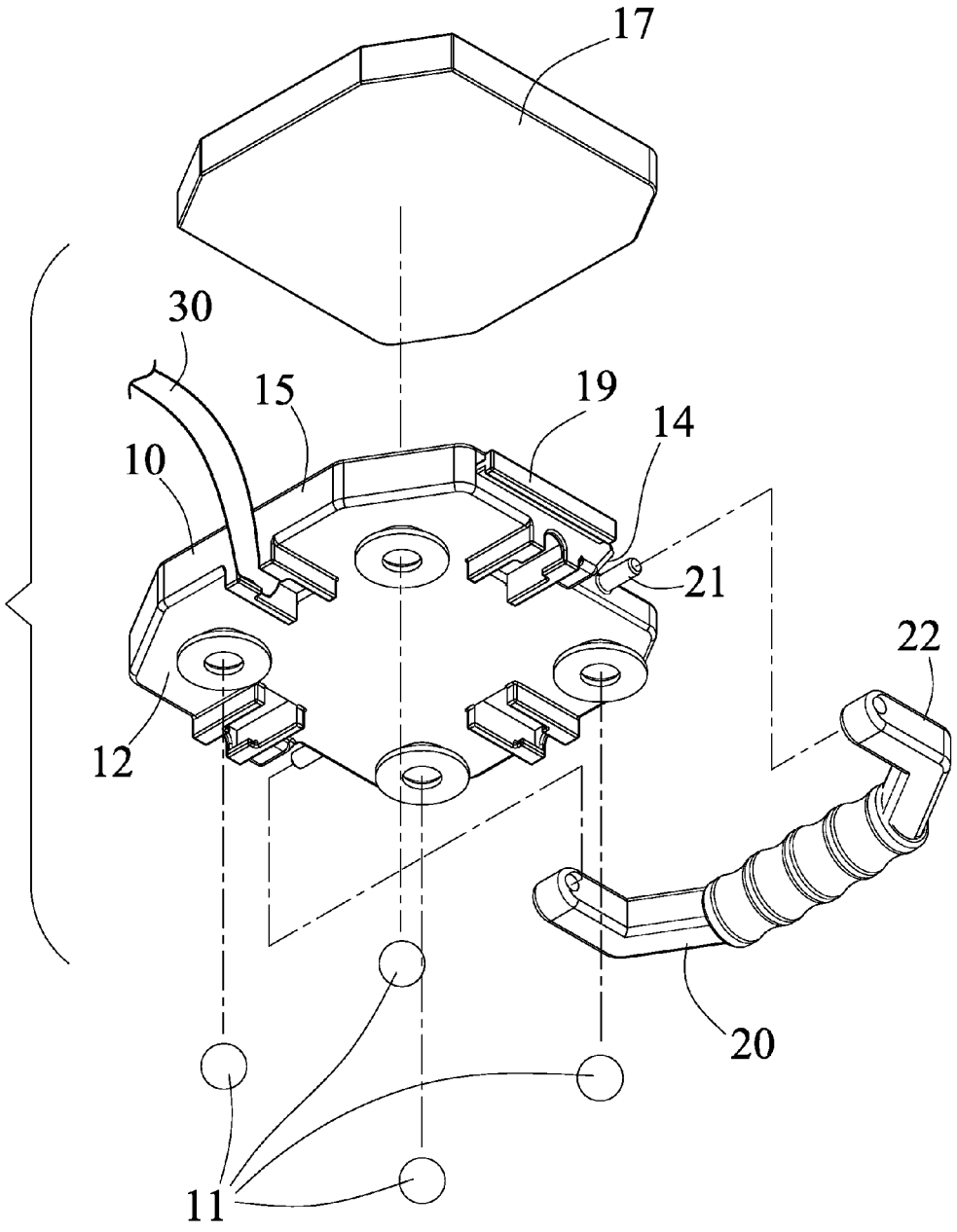
FIG. 5 is another partial exploded view as seen from the bottom portion of the exercising device.
Figure 6:
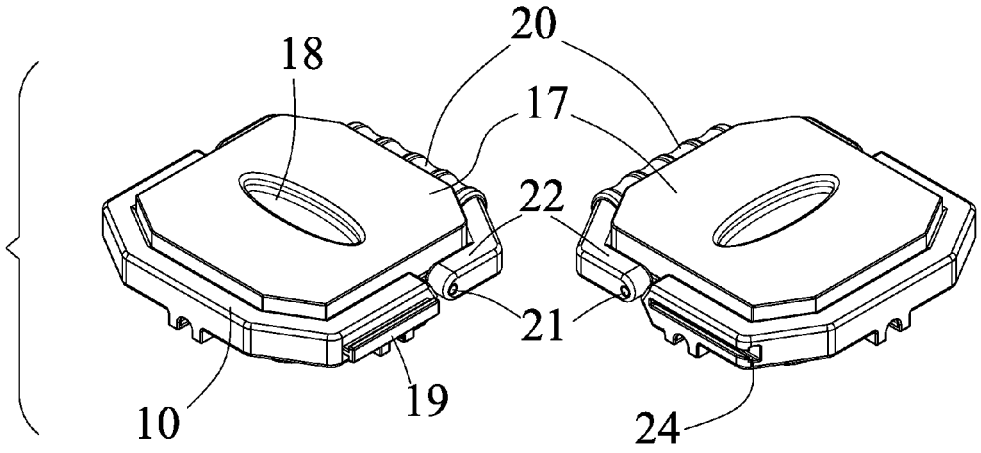
FIG. 6 is a further partial exploded view illustrating the operation and the combination of two of the exercising devices.
Figure 7:
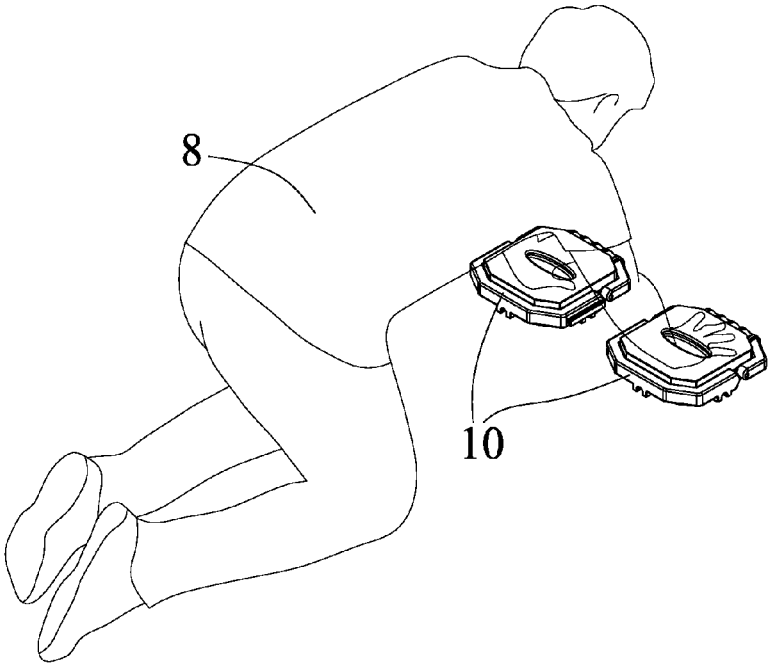
FIGS. 7, 8, 9, 10, 11 are perspective views illustrating the operation of the exercising device.
Figure 8:
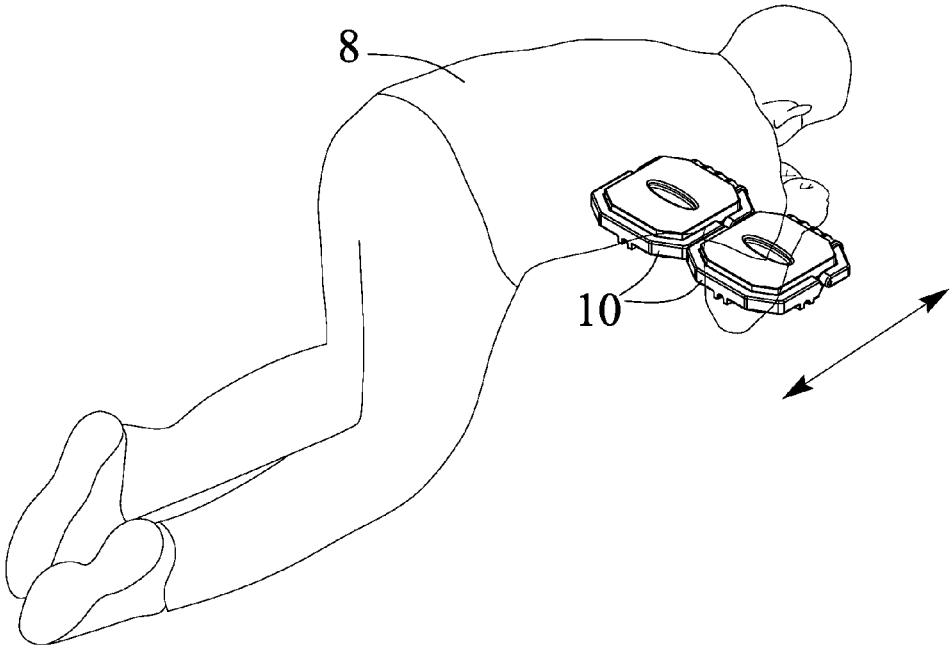
Figure 9:
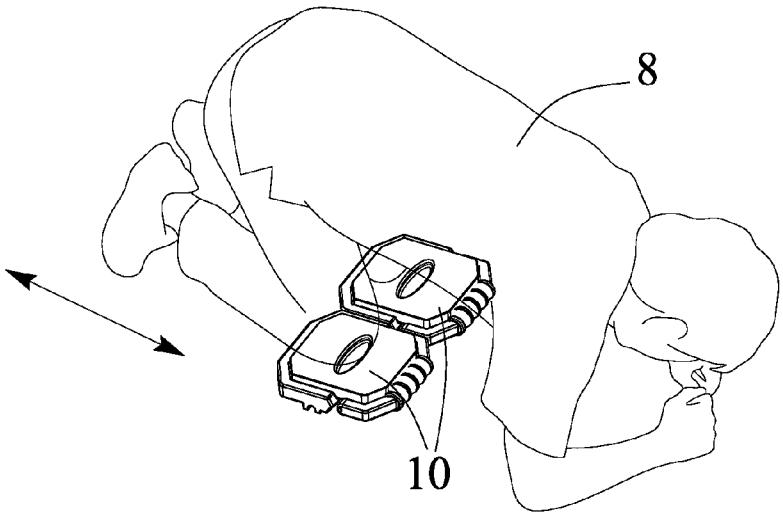
Figure 10:
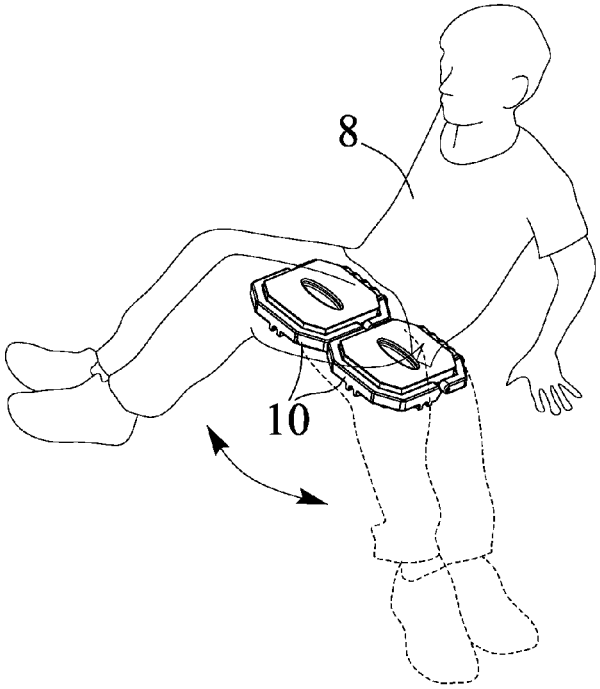
Figure 11:
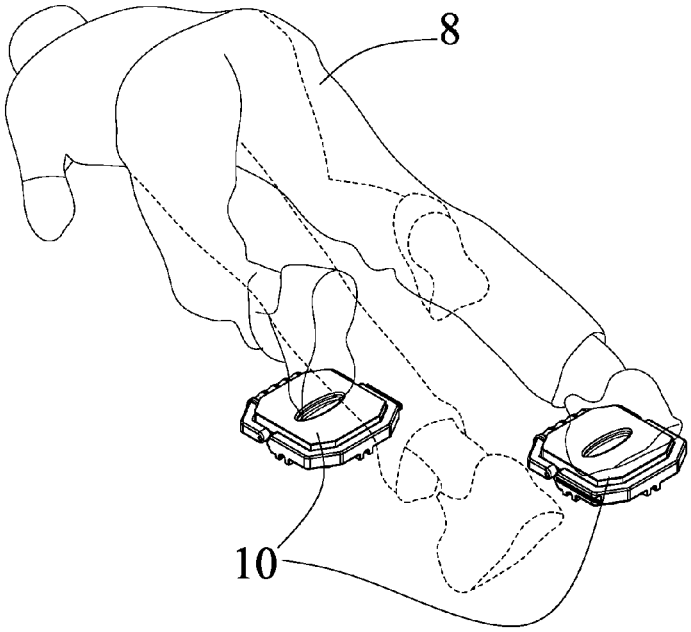
Figure 12:
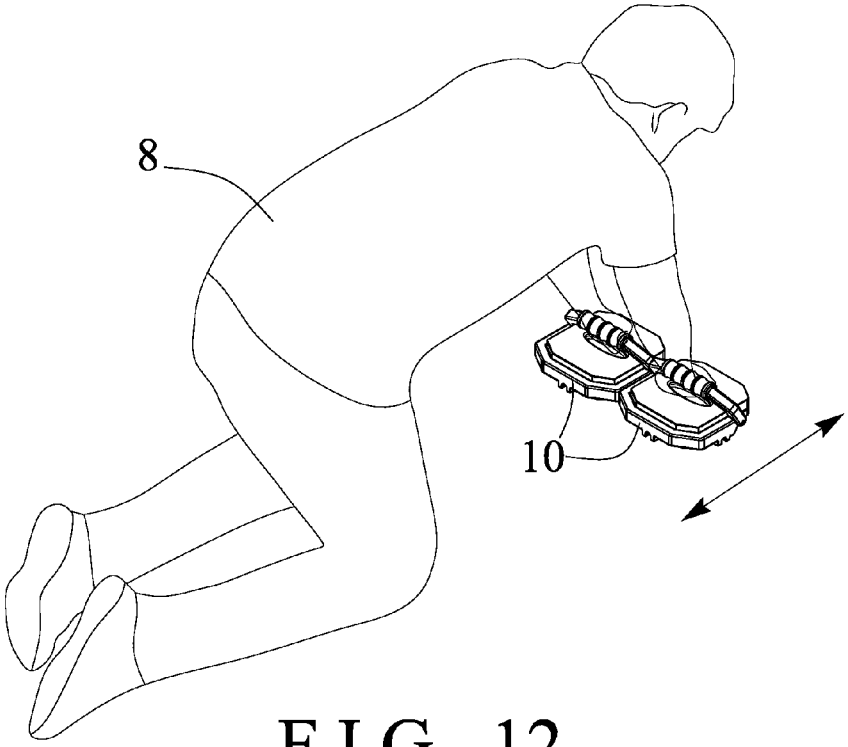
FIGS. 12, 13, 14, 15 are upper perspective views similar to FIGS. 7-11, illustrating the operation of the exercising device.
Figure 13:
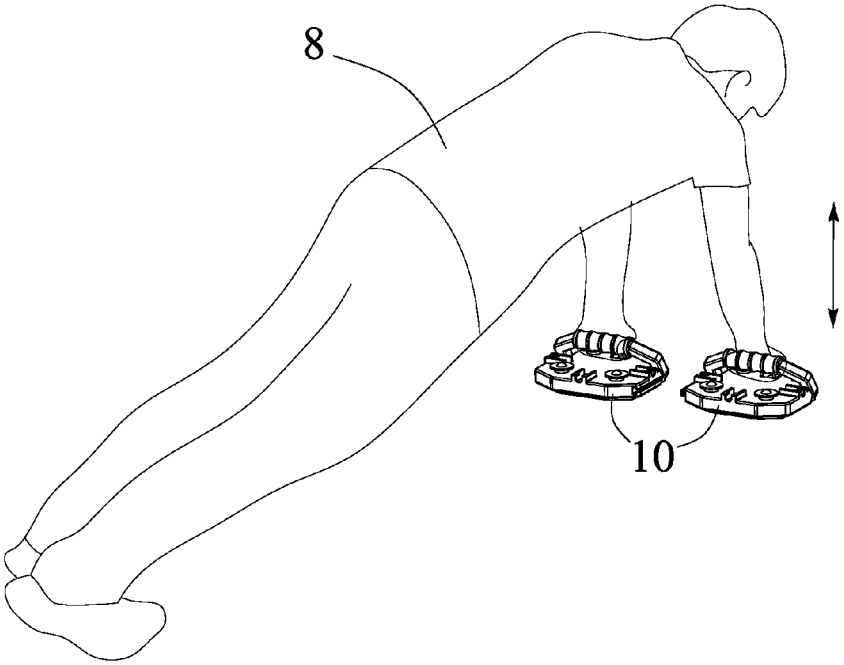
Figure 14:
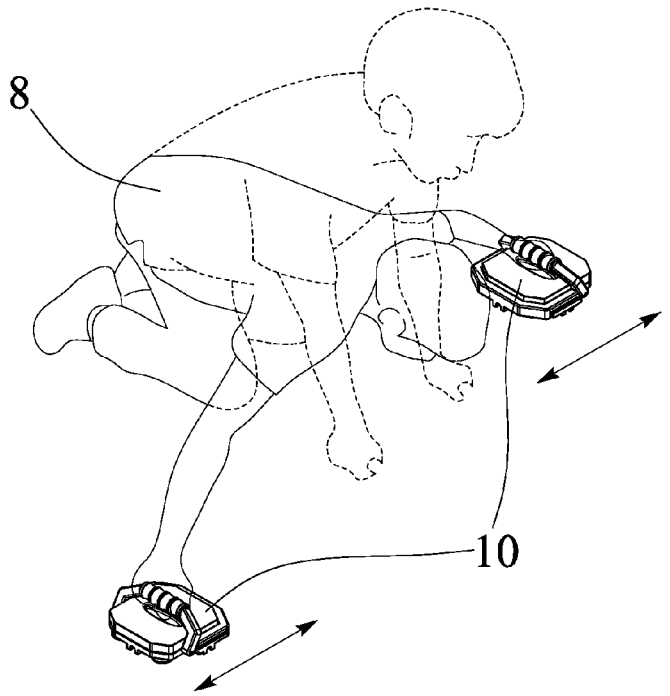
Figure 15:
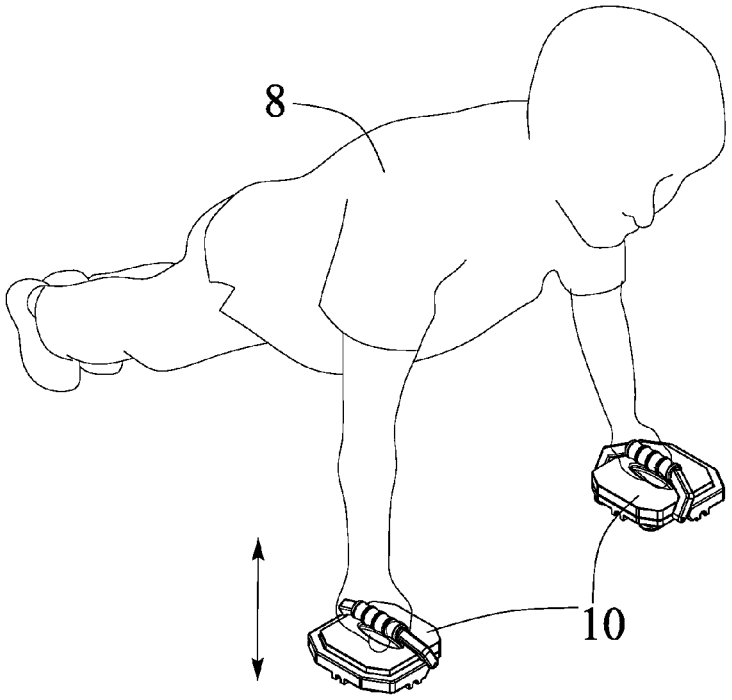
Figure 16:
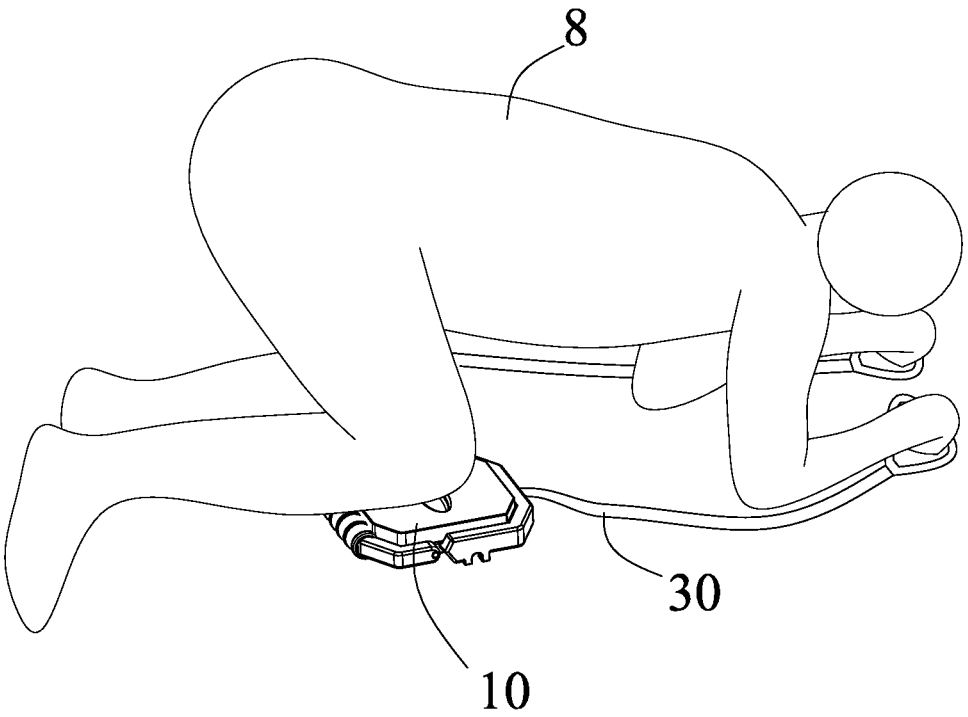
FIG. 16 is another perspective view illustrating the operation of the exercising device.

As shown in FIGS. 5 and 16, one or more elastic wires or ropes or cables 30 attached or mounted or secured or coupled to the bottom portion of the housing member 10 for being pulled or pushed by the user to conduct the other elastic exercises or the like, and/or for pulling or applying the elastic forces to the housing members 10 or the like.

Accordingly, the wheeled and hand-held sliding exercising device in accordance with the present invention includes a handle detachably secured to a wheeled housing member for allowing the handle to be selectively attached to the wheeled housing member at a working position or at a compact folding position.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercising device comprising:

a housing member including at least one roller attached to said housing member, and said housing member including two seats provided thereon, said housing member including a bulge extended therefrom for forming said seats, said housing member including a male engaging member provided thereon, a handle device including two end portions pivotally attached to said housing member with a pivot spindle for allowing said handle device to be rotated relative to said housing member between an upwardly extended working position and a folding position, said seats of said housing member being engageable with said end portions of said handle device for supporting said handle device at the upwardly extended working position, and an auxiliary housing member including a female engaging member provided thereon for engaging with the male engaging member and for allowing the housing members to be selectively coupled together.

2. The exercising device as claimed in claim 1, wherein said seats are defined at end portions of said bulge.

3. The exercising device as claimed in claim 1, wherein said housing member includes a recess formed in an upper portion of said housing member for engaging with a pad.

* * * * *